US006578229B1

(12) United States Patent
Dziallas et al.

(10) Patent No.: US 6,578,229 B1
(45) Date of Patent: Jun. 17, 2003

(54) HAND-HELD DEVICE FOR REMOVING JOINT FILLERS

(75) Inventors: Michael Dziallas, Loerrach (DE); Martin Majolo, Erkelenz (DE); Tilwin Lepsius, Duesseldorf (DE); Lydia Duhm, Duesseldorf (DE); Roy Van Swieten, Heusden (NL)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/763,976

(22) PCT Filed: Aug. 21, 1999

(86) PCT No.: PCT/EP99/06133

§ 371 (c)(1),
(2), (4) Date: Jun. 18, 2001

(87) PCT Pub. No.: WO00/12842

PCT Pub. Date: Mar. 9, 2000

(30) Foreign Application Priority Data

Aug. 31, 1998 (DE) ..... 298 15 585 U

(51) Int. Cl.[7] ..... A47L 13/02; A47L 17/06

(52) U.S. Cl. ..... 15/236.05; 15/236.01; 15/235.3; 15/235.4

(58) Field of Search ..... 15/236.05, 235.3–235.7, 15/235.8, 236.01, 236.06, 236.09; D8/98, 45; 30/278–280

(56) References Cited

U.S. PATENT DOCUMENTS

| | | | | | |
|---|---|---|---|---|---|
| 3,744,079 | A | | 7/1973 | Krause | 150/235.7 |
| 3,846,060 | A | | 11/1974 | Otis | 425/458 |
| 3,892,039 | A | * | 7/1975 | Fisher | 30/279.2 |
| D314,696 | S | * | 2/1991 | Lucarelli | D8/45 |
| D332,901 | S | * | 2/1993 | Campbell | D8/45 |
| D333,217 | S | * | 2/1993 | Gingras | D45/135 |
| D413,445 | S | * | 9/1999 | deBlois et al. | D4/138 |

FOREIGN PATENT DOCUMENTS

| | | |
|---|---|---|
| DE | 295 01 724 | 5/1995 |
| DE | 94 22 011 | 10/1997 |
| EP | 0 924 366 | 6/1999 |

* cited by examiner

*Primary Examiner*—Robert J. Warden, Sr.
*Assistant Examiner*—S Balsis
(74) *Attorney, Agent, or Firm*—Stephen D. Harper; Gregory M. Hill

(57) ABSTRACT

The present invention relates to a device for removing joint filler and a method of using the same. The device includes a body member and a peeling element located adjacent to the front end of the body member. The peeling element includes at least two peeling points, where the first peeling point is located proximate to the topside of the peeling element and the second peeling point is located proximate to the underside of the peeling element. The device also includes an opening located between the peeling element and body member.

8 Claims, 1 Drawing Sheet

HAND-HELD DEVICE FOR REMOVING JOINT FILLERS

CROSS REFERENCE TO RELATED APPLICATIONS

This application is a national stage application under 35 U.S.C §371 of international application PCT/EP99/06133 filed Aug. 21, 1999, the international application not being published in English. This application also claims priority under 35 U.S.C §119 to DE 298 15 585.0 filed on Aug. 31, 1998.

FIELD OF THE INVENTION

The invention relates to a hand-held device for removing joint fillers, particularly joint sealants, from joints, comprising a handle region for a hand of a user and a peeling element at the front.

BACKGROUD OF THE INVENTION

In the field of, in particular, sanitation, floor tile and cladding tile joints are frequently closed off especially between floor and wall by joint sealants of, for example, silicon. However, with time there is a requirement to refill joints of that kind with a joint sealant if the old joint sealant has become defective. For that purpose it is necessary to remove the old joint sealant as completely as possible from the joint to be newly grouted.

Conventional metal tools are frequently used for that purpose, for example spatulas, screwdrivers and such like. The removal of joint sealants with tools of that kind is, however, very inconvenient and laborious and moreover scratching of the underlying surface, for example the wall adjoining the floor tiles, often occurs. In addition, there is also a risk of injury for the user especially if sharp-edged metal tools are used. Other known approaches to the problem have a chemical basis and cause separation of the joint sealant, which frequently consists of silicon. However, these chemical substances are similarly connected with risks for the user, as they contain hazardous, corrosive, irritative and/or solvent-loaded substances. Moreover, there is a subsequent problem of disposal.

There is already knowledge of a hand-held device, according to the category in question, of plastics material, the front end of which has a peeling element formed by two differently designed blade-shaped elements. In that case it is necessary to penetrate the joint sealant by the first blade-shaped element, which runs to a point, and to quasi slit open the joint sealant along the entire joint, wherein this expediently has to take place at both side edges of the joint. Subsequently the hand-held device is then brought into a different position and the thus preliminarily loosened joint sealant is removed or peeled from the joint by the second blade-shaped element. Even if this known hand-held device offers advantages relative to the above-described approaches, it is, as before, worthy of improvement. Thus, with this hand-held device a substantial amount of time is still necessary for removal of the joint sealant from a joint because, as described above, the hand-held device has to be guided along the joint more than once in order to remove the joint sealant from the joint. Moreover, an entirely faultless removal is guaranteed only if the hand-held device is positioned exactly, especially in the first cutting process. A further disadvantage is that the known hand-held device has two curved blades which do not allow the mass, which is to be removed, to be fully reached in corner regions. Moreover, the shape is not optimal and the sealant is often only partially slit.

A hand-held device of the category in question is also known from German Utility Model DE-U-94 22 011. This hand-held device has at its tip a blade which can be pressed together, in correspondence with the joint width to be dealt with, with formation of a curved peeling element. A disadvantage of this prior known hand-held device is that a peeling effect can be achieved only with a pushing action.

It is the object of the invention to so improve a hand-held device according to the category in question that not only a pulling, but also a pushing, action is possible.

SUMMARY OF THE INVENTION

In accordance with the invention this object is met by a hand-held device of the kind denoted in the introduction in that the peeling element is constructed as a peeling beak which runs to a point and is open at the back while forming a further beak region.

The hand-held device according to the invention is, for removal of joint sealant from a joint, simply inserted in a joint so that the two side flanks of the peeling beak lie approximately at the two areas bordering the joint and subsequently the hand-held device is moved along the joint, preferably by pushing, whereby the joint sealant is released from the substrate in one working step in the vicinity of both joint flanks. Alternatively, the hand-held device can also be moved, without great exercise of force, by pulling; in this case, too, the side-flanks of the peeling beak then lie at both edge regions of the joint and ensure a largely complete detaching of the joint sealant in one working step. Through this possibility of using the hand-held device alternatively in the afore-described manner, a very flexible working results so that even corners with difficult access can be freed of joint sealant without problems. The device is thus particularly suitable, without modification, for both left-handed persons and right-handed persons. Since no protruding sharp-edged cutting edges are present there is also virtually no risk of injury for the user. Due to the peeling beak being constructed to be open at the back, detached joint sealant can issue from the hand-held device at the back so that removal thereof along an entire joint is possible in problem-free manner without interruption of the peeling process, because the detached mass issues rearwardly from the hand-held device. It is of particular further advantage in that case that by virtue of the construction of a further beak region at the beak end open at the back, the device can also be moved by pulling, whereby peeling then takes place by way of this beak region.

In an advantageous embodiment it is proposed that the two side flanks of the peeling beak are arranged at an angle of about 65° C. relative to each other. This facilitates working particularly in corner regions, for example in joints between a floor surface and a wall surface.

Handling can be further substantially improved if the peeling beak at the top passes over at the end of the side flanks into a manipulating region. The manipulating region in that case serves, apart from the handle region equally present, for the support thereon of, for example, the thumb of a user's hand whilst the hand-held device can be fully gripped in the handle region by the remaining fingers and the palm.

It has proved particularly favourable in ergonomic terms if the manipulating region passes over into the handle region, which is formed to be narrowed.

The functional capability of the hand-held device can be further enhanced if the end opposite the peeling beak is constructed as a spatula. It is possible with this spatula to, for example, directly remove the last residue of the joint sealant from smooth surfaces without needing an additional spatula for that purpose.

In order to even further improve the handling it is with advantage proposed that the manipulating region and/or the handle region is or are provided with furrow-shaped protrusions for the thumb or a finger of a hand of a user. In that case the furrow-shaped protrusions in the manipulating region serve the purpose of positioning the thumb of the user's hand when the hand-held device is used for actual removal of the joint sealant from a joint, whilst the protrusions in the handle region serve the purpose of positioning the thumb when the hand-held device is used as a spatula.

Preferably, the protrusions are formed in trough-shaped regions.

Finally, it is proposed that the hand-held device consists of plastics material and, in particular, of a plastics material which as far as possible is stable and low in abrasion. The risk of scratching the underlying surface adjacent to the joint is thereby securely avoided. Moreover, the hand-held device can be produced simply and economically. The hand-held device can, in the alternative, obviously also consist of metal or other materials.

BRIEF DESCRIPTION OF THE DRAWINGS

The invention is explained in more detail by way of example with reference to the drawing, in which.

DETAILED DESCRIPTION OF THE INVENTION

Figure 7:
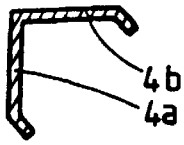
FIG. 7 shows a section according to the line VII—VII in FIG. 1.
Figure 8:
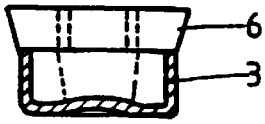
FIG. 8 shows a section according to the line VIII—VIII in FIG. 4
Figure 9:
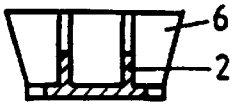
FIG. 9 shows a section according to the line IX—IX in FIG. 4.

A hand-held device according to the invention for removal of joint fillers, especially joint sealants from joints, is denoted in the drawing generally by 1. This hand-held device has first of all a narrowed hand region 2, which towards the front passes over into a manipulating region 3 which is enlarged by comparison with the narrowed handle region 2. The manipulating region 3 ends at the front in a peeling beak 4 which runs to a point and the two side flanks of which are denoted by 4*a* and 4*b*. These side flanks 4*a* and 4*b* are arranged at an angle of approximately 65° C. to one another as evident from FIG. 7. The side flanks in that case pass over at the top into an angled region 4*a*' or 4*b*' and from this into side walls of the manipulating region 3.

Figure 1:
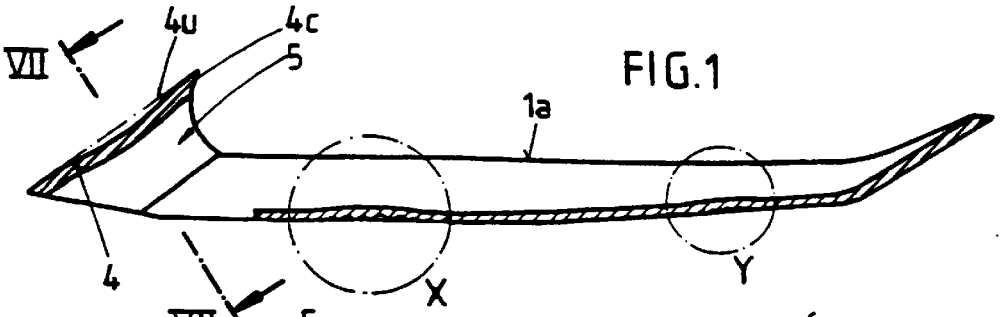
FIG. 1 shows a section through a hand-held device in accordance with the invention according to the line II—II in FIG. 2.
Figure 2:
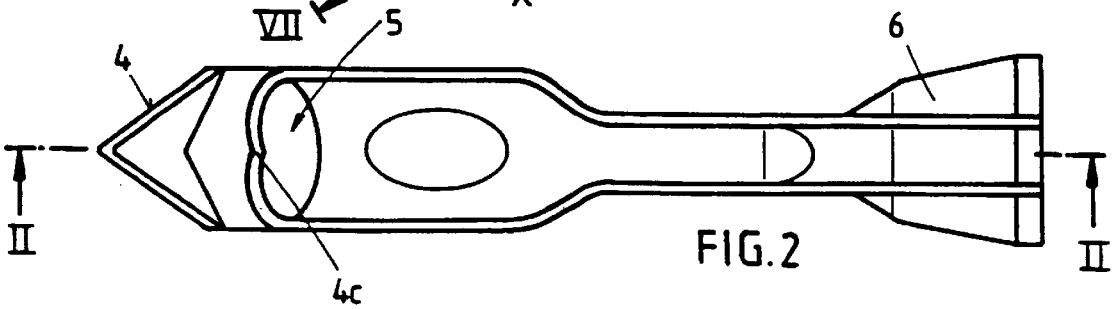
FIG. 2 shows the hand-held device in a view from below.
Figure 3:
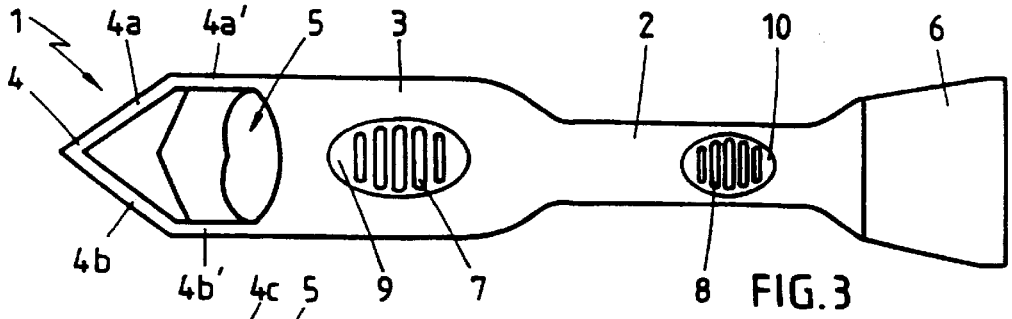
FIG. 3 shows the hand-held device in a view from above.
Figure 4:
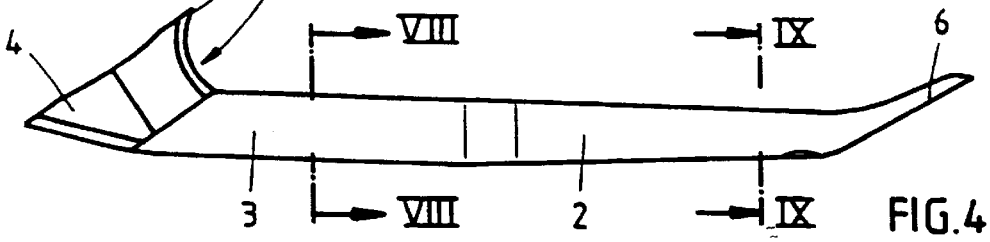
FIG. 4 shows the hand-held device in a side view.
Figure 5:
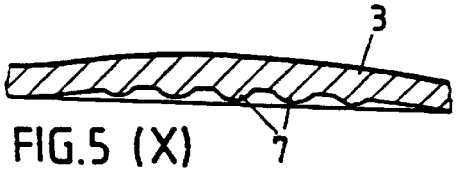
FIG. 5 shows a detail of the hand-held device, to an enlarged scale, denoted by X.
Figure 6Y:
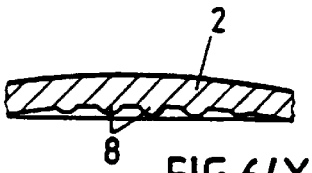
FIG. 6 shows a detail of the hand-held device, to an enlarged scale, denoted by Y.

As evident best from FIG. 1, the underside 4*u* of the peeling beak 4 is preferably constructed not rectilinearly, but to be inclined inwardly with a slight curvature. The peeling beak 4 is moreover formed to be open at the back, this region being indicated by an arrow 5. The curved end region open at the back in that case forms a further beak region 4*c*, which similarly serves as a peeling element.

The hand-held device 1 is constructed at the end opposite the peeling beak 4 as a spatula so that, apart from its peeling function, it can also be used as a spatula.

To facilitate manipulation, both the manipulating region 3 and the handle region 2 have furrow-shaped protrusions 7, 8 for the thumb or finger of a user's hand, the protrusions being formed in regions 9, 10 recessed in trough-shape. On actuation of the hand-held device with the peeling beak 4, the thumb or a finger bears on the furrow-shaped protrusions 7 and the remaining fingers together with the palm engage around the handle region 2, whereas the thumb or a finger, on use of the hand-held device 1 with the spatula 6, bears on the furrow-shaped protrusions 8 and the remaining fingers and the palm engage around the manipulating region 3.

For removal of a joint sealant from a joint the hand-held device 1 is inserted or spiked by the front pointed end of the peeling beak 4 into the joint sealant and can then be moved along the joint by pushing forwardly. In that case, the hand-held device 1 is oriented with its underside 1*a* towards the joint. Alternatively, however, the hand-held device can also be pulled along the joint, in which case the beak region 4*c* is then effective as peeling element.

Any residues can be removed in simple manner by the spatula 6; moreover, the hand-held device 1 can also be used at any time as a normal spatula.

The hand-held device 1 preferably consists entirely of plastics material, preferably of a low-wear and low-abrasion plastics material.

The invention is obviously not restricted to the illustrated embodiment. Further refinements are possible without departing from the inventive concept. Thus, in particular, the physical arrangement of the side flanks 4*a* and 4*b* of the peeling beak 4 can be selected to be different in accordance with the respective conditions of use and the spatula can, for example, obviously also be omitted.

What is claimed is:

1. A device for removing joint filler comprising:

a) a body member comprising (i) a front end and an opposing rear end, (ii) a topside and an opposing underside;

(iii) a manipulating region at the front end; and (iv) a handle region between the manipulating region and the rear end, wherein the handle region is narrower than the manipulating region;

b) a peeling element located adjacent to the front end of the body member and having a topside and an underside, wherein the peeling element comprises a first peeling point and a second peeling point, wherein the first peeling point is located proximate to the topside of the peeling element and wherein the second peeling point is located proximate to the underside of the peeling element, wherein the peeling element comprises two side flanks that are joined to form the first and second peeling points; and c) an opening located between the peeling element and the body member wherein the opening extends from the topside of the peeling element to the underside of the peeling element.

2. The device of claim 1 wherein the side flanks are joined at an angle of approximately 65° to one another.

3. The device of claim 1 wherein the rear end of the body member is in the form of a spatula.

4. The device of claim 3 wherein the body member comprises one or more recessions located in the manipulating region, the handle region, or combinations thereof for placement of a hand, finger, or thumb.

5. The device of claim 4 wherein the recessions comprise one or more protruding ridges.

6. The device of claim 5 wherein the body member and peeling element comprise a plastic material.

7. The device of claim 1 wherein the rear end of the body member is in the form of a spatula.

8. A process for removing joint filler comprising (a) providing a tool comprising (i) a body member comprising a front end and an opposing rear end, and a topside and an opposing underside;

(ii) a peeling element located adjacent to the front end of the body member and having a topside and an underside, wherein the peeling element comprises a first peeling point and a second peeling point, wherein the first peeling point is located proximate to the topside of the peeling element and wherein the second peeling point is located proximate to the underside of the peeling element, wherein the peeling element comprises two side flanks that are joined to form the first and second peeling points;

(iii) an opening located between peeling element and body member wherein the opening extends from the topside of the peeling element to the underside of the peeling element;

(iv) a manipulating region at the front end; and (v) a handle region between the manipulating region and the rear end, wherein the handle region is narrower than the manipulating region;

(b) placing the first peeling point or second peeling point in a joint containing joint filler; and (c) pushing or pulling the tool along the joint to remove the joint filler.

* * * * *